US008545339B1

(12) United States Patent
Edwards

(10) Patent No.: US 8,545,339 B1
(45) **Date of Patent: *Oct. 1, 2013**

(54) GOLF GRIP GUIDE

(76) Inventor: Gareth Edwards, Frimley (GB)

( * ) Notice: Subject to any disclaimer, the term of this patent is extended or adjusted under 35 U.S.C. 154(b) by 0 days.

This patent is subject to a terminal disclaimer.

(21) Appl. No.: 13/553,286

(22) Filed: Jul. 19, 2012

(51) Int. Cl.
*A63B 69/36* (2006.01)
*A63B 53/14* (2006.01)
*A41D 19/00* (2006.01)

(52) U.S. Cl.
USPC ..... 473/205; 473/212; 2/161.2

(58) Field of Classification Search
USPC ..... 473/201, 203–206, 212, 226, 450, 473/458
See application file for complete search history.

(56) References Cited

U.S. PATENT DOCUMENTS

| | | | | |
|---|---|---|---|---|
| 3,848,874 | A * | 11/1974 | Elkins, Jr. | 473/409 |
| 6,272,686 | B1 * | 8/2001 | Liu | 2/161.2 |
| 8,070,619 | B2 * | 12/2011 | Edwards | 473/205 |
| 8,292,752 | B2 * | 10/2012 | Wise et al. | 473/205 |
| 2009/0217441 | A1 * | 9/2009 | McCree et al. | 2/161.2 |
| 2011/0263346 | A1 * | 10/2011 | Wise et al. | 473/205 |

* cited by examiner

*Primary Examiner* — Nini Legesse
(74) *Attorney, Agent, or Firm* — Sutherland Asbill & Brennan LLP

(57) ABSTRACT

The present invention provides a golf grip training aid that includes a golf grip training aid that includes a glove and a golf club handle grip or grip cover, the handle grip or grip cover having a plurality of discrete co-operating contact zones marked thereon spaced apart therealong in locations to define a good grip position and adapted to be co-operatively used with corresponding discrete co-operating contact zones marked on the glove whereby the user may discern when their hand in the glove is in the required good grip position on the handle grip or grip cover by mutual covering of the co-operating contact zones on the glove with the co-operating contact zones on the handle grip or grip cover.

18 Claims, 2 Drawing Sheets

GOLF GRIP GUIDE

FIELD OF THE INVENTION

The present invention concerns a golf grip training/aligning aid for use to train and guide individuals in the optimal grip of the handle of a golf club.

BACKGROUND

For a novice to learn to play golf well they need to concentrate initially not only generally on their posture/stance and swing but also very importantly on how they grip the handle of the golf club. Indeed, incorrect grip will greatly affect the swing and subsequent strike and trajectory of the golf ball and correct grip is critical to good technique. This fact has not escaped the attentions of the golf equipment industry and a number of proposals have been made for golf grip training aids to address this, with patents having been applied for on this over the years. These are often systems that have markings/visual indicia, commonly both on the golf club handle grip and a glove, the glove having corresponding markings to co-ordinate with the markers on the grip. Examples include U.S. Pat. No. 3,848,874, U.S. Pat. No. 6,272,686, WO2000/0020078 and WO2007/120058. These generally teach the trainee golfer to grip the golf club handle in one or two recognised manners for optimum performance. The trainee continues to use them until he or she has built up the necessary muscle memory and no longer needs the training aid. However these have a problem in that they rely entirely on the line of sight of the trainee which can be off angle and the markings may not be sufficiently visible to the player for good accurate alignment as the hand proceeds to wrap around the handle to grip it.

In more sophisticated systems there are specially formed handle grips that are moulded to provide contours for the fingers and thumbs to follow to guide them to achieve the correct grip position. These are not normally coordinated with gloves. Examples include U.S. Pat. Nos. 2,484,762, 2,628,100 and 5,299,802. Such systems can be costly to produce and can still be somewhat tricky to use.

As an aside, in un-related developments some manufacturers in the golf equipment industry have proposed systems for helping golfers maintain their grip position (once they are already familiar with the correct grip position) as a countermeasure against twist or slippage in wet conditions or if the player has a weak grip. These partly resemble the grip training aids but are not designed as training aids and don't guide the user reliably to the correct grip position. Example patents on such devices include GB1,013,381, GB2,313,320, U.S. Pat. No. 3,532,344, U.S. Pat. No. 3,508,280, US2002/147054, US2007/0184911, WO01/23046, WO 2004/105898, WO2005002689 and U.S. Pat. No. 5,715,539 which all have a glove and a handle grip (or handle grip cover) where each of the glove and grip (or handle grip cover) are arranged to co-operatively engage with each other, commonly through bands of hook and loop fasteners (VELCRO®) or, in the latter case, magnets. In US2004/132538 the device is arranged as a training aid for positional guidance, but there is no precise and reliable tactile verification of correct positioning. It has visual guidance and the contact of the opposing zones is augmented by VELCRO bonding but there is no control over orientation of positioning or extent of overlap of the opposing VELCRO tabs and the user can easily adopt an incorrect grip even though there is an engagement of VELCRO tabs.

It is an object of the present invention to overcome the problems of the existing golf grip training/grip aligning aids so that an effective aid may be provided that most golfers can get affordable access to and be able to use reliably to acquire the right grip technique for success and yet be able to use the aid not just as a training aid but even in competitive golfing matches where permitted.

BRIEF SUMMARY

According to a first aspect of the present invention there is provided a golf grip training or grip aligning aid that comprises a glove and a golf club handle grip or grip cover, the handle grip or grip cover having a plurality of discrete co-operating contact zones marked thereon spaced apart thereallong in locations to define a good grip position and adapted to be co-operatively used with corresponding discrete co-operating contact zones marked on the glove whereby the user may discern when their hand in the glove is in the required good grip position on the handle grip or grip cover by mutual covering of the co-operating contact zones on the glove with the co-operating contact zones on the handle grip or grip cover.

BRIEF DESCRIPTION OF THE DRAWINGS

A preferred embodiment of the present invention will now be further described, by way of example only, with reference to the accompanying drawings, in which.

DETAILED DESCRIPTION

Figure 1:
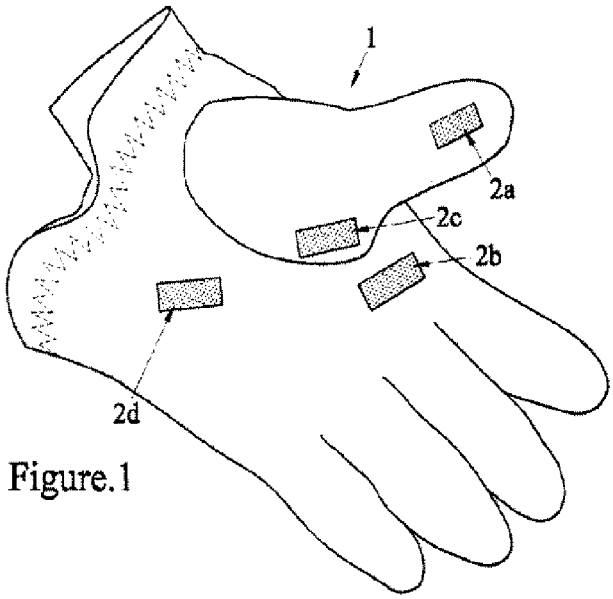
FIG. 1 is a perspective view of a golfing glove of the training aid.

Preferably the co-operating contact zones on the glove are formed as two-dimensional shaped (eg oblong-shaped) zones and the co-operating contact zones of the handle grip I grip cover are formed as corresponding shaped zones for mating with those zones in a fixed position.

The respective co-operating contact zones on the glove and the golf club handle grip or grip cover are generally two-dimensional. They serve as visual aids/guides to correct positioning but they are not three-dimensional and don't alter the profile/surface contours of the glove and the golf club handle grip or grip cover. Accordingly they can enable the aid to be used not only in training but also in competitive golf.

The co-operating contact zones may be marked by applying a paint, dye or ink to the surface of the glove and to the surface of a golf club handle grip or grip cover, or they may be marked by the surface of the glove and golf club handle grip or grip cover being inlaid or otherwise assembled with a material of a distinct visual appearance but which is flush/level with the surrounding surface. Most suitably the zones are marked by being of a distinct colour. By way of example, the glove and grip may each be of white leather and have inlaid or stitched into them differently colored leather patches that serve as the co-operating contact zones.

The individual co-operating contact zones are preferably colour-coded or otherwise labeled, eg with alphanumeric coding such as a series of letters or numbers or both, or shape-coded to visually differentiate each from each other and facilitate matching the corresponding co-operating contact zones on the handle grip or grip cover.

The handle grip or grip cover may be formed in a substantially conventional manner for a golf club handle grip as a tube/sleeve of pliable fabric and installed by conventional grip replacement technique, ie is slid over the handle of the golf club and suitably adhered in place by double-sided adhesive tape using a solvent such as white spirits to temporarily stop the adhesive sticking until the tube is in place. Preferred fabrics for the handle grip or grip cover include rubber, neoprene or other elastomeric fabrics and leather or faux/synthetic leather.

Preferably at least two of the co-operating contact zones on the glove are substantially aligned with each other. Where there is a third zone on the glove palm this is suitably substantially parallel to the other two co-operating contact zones.

In the preferred embodiment the aid may comprise a rigid handle grip that is stand-alone or incorporates a short rod or tube to simulate part of a golf club handle so that the user may practice holding and perfecting grip without need of a full size golf club The discrete multiple co-operating contact zones on the handle grip provide a visual guide to correct grip alignment, guiding the user's fingers to grip the handle at the correct position, not radially offset (twisted) or longitudinally offset (slipped) relative to where it should be.

Figure 2:
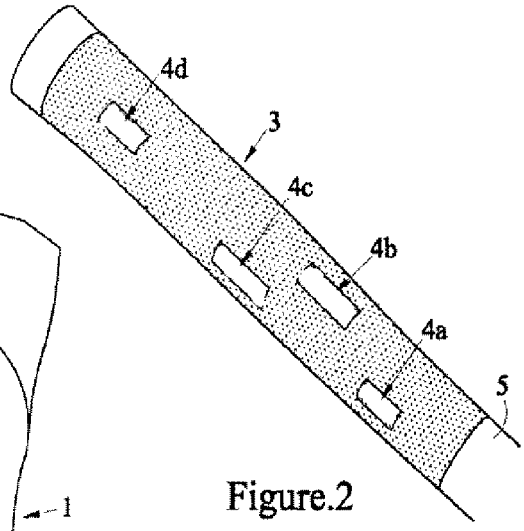
FIG. 2 is a perspective view of a golf club handle grip of the training aid.
Figure 3:
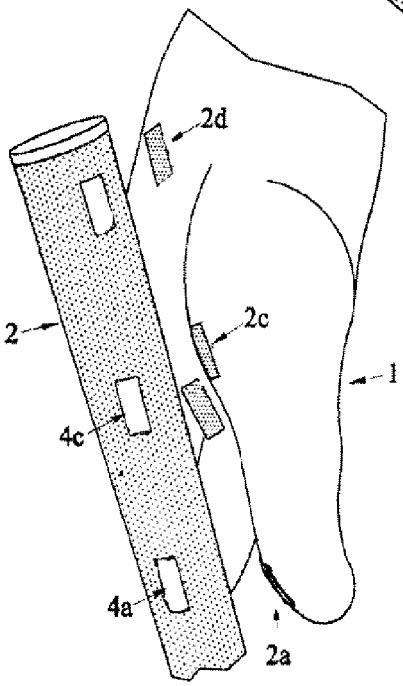
FIG. 3 is a first view of the aid ready for use with the user's hand ensheathed in the glove and being brought into proximity with the golf club handle grip.
Figure 4:
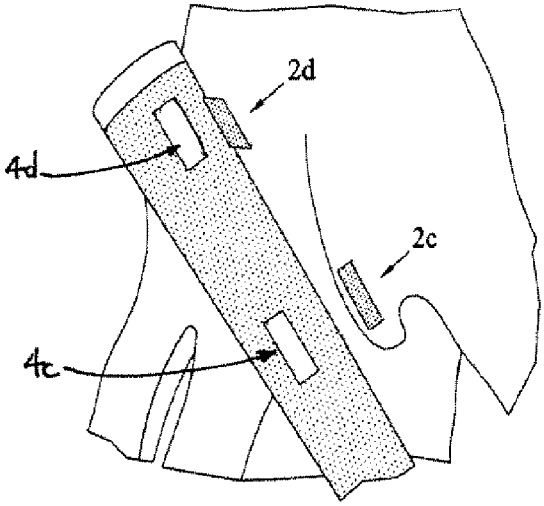
FIG. 4 is a second view of the aid being used and the glove beginning to wrap in place around the golf club handle grip.
Figure 5:
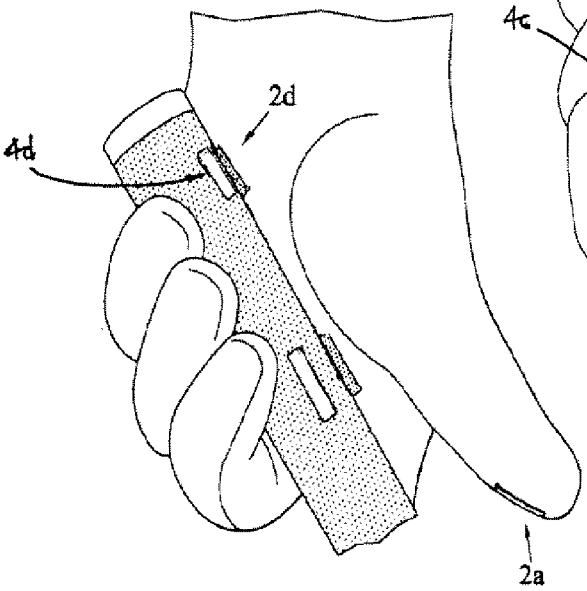
FIG. 5 is a third view of the aid being used and the glove wrapping further in place around the golf club handle grip.
Figure 6:
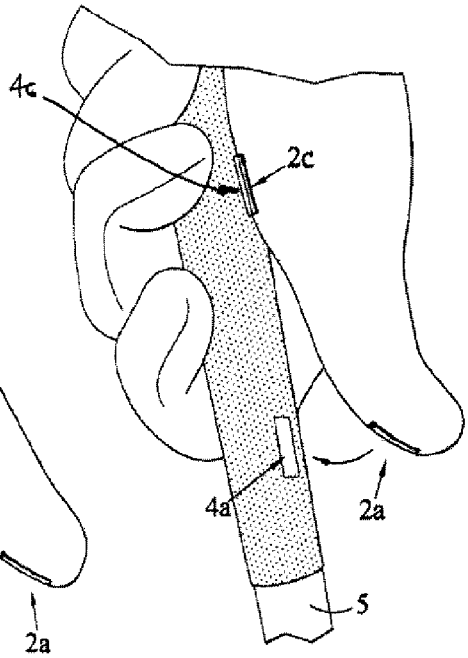
FIG. 6 is a final stage view of the aid being used with palm and fingers of the glove in place and the thumb moving into place to give the desired correct grip position.

Referring firstly to FIGS. 1 and 2, the illustrated golf grip training aid comprises a glove 1 and a golf club handle grip 3.

The glove 1 is suitably a substantially conventional leather golfer's glove but is modified by provision of an array of four oblong tablet-shaped colored marked zones 2*a*-2*d*. The zones 2*a*-2*d* may suitably be of rubber or even added leather adhered or stitched or otherwise presented on the palm side of the glove 1. They are arranged with three aligned substantially in a line diagonally across the glove 1 with two 2*d*, 2*c* aligned on the palm of the glove 1 and a third 2*a* on the thumb of the glove 1. A fourth 2*b* is on the palm parallel to the aligned pair 2*d*, 2*c*

The marked zones 2*a*-2*d* define discrete co-operating contact zones for co-operating with equivalent co-operating contact zones 4*a*-4*d* that are provided spaced apart along the handle grip 3. The handle grip 3 has these co-operating contact zones 4*a*-4*d* formed in locations configured to define a good grip position. These co-operating contact zones 4*a*-4*d* are oblong colored markings 4*a*-4*d* that have the same plan shape as the marked zones 2*a*-*d* of the glove 1 and serve as locating guides over which the marked zones 2*a*-*d* of the glove 1 will lie when the user wraps their gloved hand around the handle grip 3 correctly. The user will thus be able to see that they have their hand in the required good grip position by the direct visual matching of the co-operating contact zones 2*a*-*d* on the glove 1 with their counter-part co-operating contact zones 4*a*-*d* on the handle grip 3.

The marked zones 2*a*-2*d* on the glove are of the same shape and size as the co-operating contact zones 4*a*-4*d*. They are each colour-coded to visually differentiate them from each other and each colour match their corresponding zone 4*a*-4*d* on handle grip 3. For example, on the glove zone 2*a* is a green oblong mark, zone 2*b* is a red oblong mark, zone 2*c* is a yellow oblong mark and zone 2*d* is a blue oblong mark. The corresponding marked zones on the grip are: zone 4*a* is a green oblong mark, zone 4*b* is a red oblong mark, zone 4*c* is a yellow oblong mark and zone 4*d* is a blue oblong mark. The visual matching of zones 2*a*-*d* and 4*a*-*d* is substantially exact so that they match colour for color, size for size and position for position when the correct grip is attained. Instead of or in addition to colour coding the respective marked zones they may be labeled with a distinguishing number and/or letter. Thus, for example, zone 2*a* is marked with numeral 1, zone 2*b* with numeral 2 et cetera and with zone 4*a* correspondingly marked with numeral 1, zone 4*b* marked with numeral 2 et cetera.

The preferred embodiment of the handle grip 3 is formed like a conventional golf club handle grip and installed in the substantially conventional manner for replacing a golf club handle grip and thus is very cheap to make and straightforward for most golfers and golf trainers to install. It is suitably a rubber sleeve that is adhered in place by double-sided adhesive tape. The marked co-operating zones 4*a*-4*d* are shown in the drawings as marked on the tubular wall of the handle grip 3.

As a simple portable variant that the trainee can carry around in their pocket to practice regularly to quickly build up the needed muscle memory in their hand for the grip, the aid may be formed instead as a more rigid handle grip that suitably incorporates a short rigid rod or tube core to simulate part of a golf club handle so that the user may practice holding the device and perfecting grip without need of a full size golf club.

As can be seen from FIGS. 3 to 6 the successive stages of enwrapping the user's gloved hand around the grip 3 are straightforward leading progressively to matching of all four marked zones 2*a*-*d* of the glove 1 with the corresponding marked zones 4*a*-*d* of the grip 3. The discrete multiple co-operating contact zones on the handle grip 3 provide the necessary level of visual guidance to guide and ensure the correct alignment, guiding the user's fingers to reliably grip the handle at the correct position, not radially offset (twisted) or longitudinally offset (slipped) relative to where it should be.

Although described and illustrated as involving only one glove, corresponding to the left hand in right-handed golfers, the invention may also be practiced with provision of zone(s) 2*a*-*d* on a glove for the other hand too and that correspond with zones 4*a*-*d* on the grip. For most preferred grip patterns, however, the other hand simply overlies the first and there is no need for the other hand to be keyed to the grip 3.

The invention claimed is:

1. A golf grip aligning aid that comprises a glove having a wrist, palm, fingers, and thumb, and a golf club handle grip or grip cover, the handle grip or grip cover having a plurality of discrete co-operating contact zones marked thereon spaced apart therealong in locations to define a good grip position and adapted to be co-operatively used with corresponding discrete co-operating contact zones marked on the glove whereby the user may discern when their hand in the glove is in the required good grip position on the handle grip or grip cover by mutual covering of the co-operating contact zones on the glove with the co-operating contact zones on the handle grip or grip cover, wherein the respective co-operating contact zones on the glove and the golf club handle grip or grip cover are generally two-dimensional, serving as visual aids to correct positioning but not altering the profile/surface contours of the glove and the golf club handle grip or grip cover, the glove having a first co-operating contact zone comprising a discrete distinct marking on the palm of the glove near the wrist of the glove remote from the thumb of the glove and a second co-operating contact zone comprising a discrete distinct marking on the thumb of the glove.

2. A golf grip training aid as claimed in claim 1, wherein the co-operating contact zones on the glove are formed as two-dimensional shaped (eg oblong-shaped) zones and the co-operating contact zones of the handle grip/grip cover are formed as corresponding shaped zones for mating with those zones in a defined position.

3. A golf grip training aid as claimed in claim 1, wherein at least one of the respective co-operating contact zones on the glove and the golf club handle grip or grip cover is marked by applying a paint, dye or ink to the surface of the glove and to the surface of a golf club handle grip or grip cover.

4. A golf grip training aid as claimed in claim 1, wherein at least one of the respective co-operating contact zones on the glove and the golf club handle grip or grip cover is marked by the surface of the glove and golf club handle grip or grip cover being inlaid or otherwise assembled with a material of a distinct visual appearance but which is flush/level with the surrounding surface.

5. A golf grip training aid as claimed in claim 1, wherein the zones are marked by being of a distinct different colour from the surface on which they are marked.

6. A golf grip training aid as claimed in claim 4 or 5, wherein the glove and grip are each of a material of a first colour and have inlaid or stitched into them differently colored material patches that serve as the co-operating contact zones.

7. A golf grip training aid as claimed in claim 1, wherein the co-operating contact zones are colour-coded or otherwise labeled, such as with alphanumeric coding such as a series of letters or numbers or both, or shape-coded to visually differentiate each from each other and facilitate matching the corresponding co-operating contact zones on the handle grip or grip cover.

8. A golf grip training aid as claimed in claim 1, wherein the handle grip or grip cover is formed of pliable fabric that ensheathes the golf club handle.

9. A golf grip training aid as claimed in claim 8, wherein handle grip or grip cover is of a length of rubber, neoprene or other elastomeric fabrics and leather or faux/synthetic leather.

10. A golf grip training aid as claimed in claim 1, wherein there are at least two co-operating contact zones on the palm of the glove, each comprising a discrete distinct marking.

11. A golf grip training aid as claimed in claim 10, wherein there is a third co-operating contact zone on the palm of the glove.

12. A golf grip training aid as claimed in claim 11, wherein the third co-operating contact zone on the glove palm is substantially parallel to the other two co-operating contact zones thereon.

13. A golf grip training aid as claimed in claim 1, wherein at least two of the co-operating contact zones on the glove are substantially aligned with each other.

14. A golf grip training aid as claimed in claim 1, wherein the aid comprises a rigid handle grip that is stand-alone or incorporates a short rod or tube to simulate part of a golf club handle so that the user may practice holding and perfecting grip without need of a full length golf club.

15. A golf grip training aid as claimed in claim 1, wherein the handle grip is applied to the handle of a golf club after first removing the existing handle grip of the club and is adhered to the handle of the club.

16. A golf grip training aid as claimed in claim 1, wherein the glove has a third co-operating contact zone comprising a second discrete distinct marking on the palm of the glove, near the base of the thumb of the glove.

17. A golf grip training aid as claimed in claim 16, wherein the second discrete distinct marking on the palm of the glove is substantially aligned with the first discrete distinct marking on the palm of the glove.

18. A golf grip training aid as claimed in claim 17, wherein the glove has a fourth co-operating contact zone on the glove comprising a third discrete distinct marking on the palm of the glove substantially parallel to first, second and third co-operating contact zones.

* * * * *